US008763654B2

(12) United States Patent
Gras et al.

(10) Patent No.: US 8,763,654 B2
(45) Date of Patent: Jul. 1, 2014

(54) FILLING SYSTEM

(75) Inventors: Norman Gras, Horrweiler (DE); Ludwig Clüsserath, Bad Kreuznach (DE); Manfred Härtel, Bretzenheim (DE)

(73) Assignee: KHS GmbH, Dortmund (DE)

( * ) Notice: Subject to any disclaimer, the term of this patent is extended or adjusted under 35 U.S.C. 154(b) by 8 days.

(21) Appl. No.: 13/146,075

(22) PCT Filed: Mar. 20, 2010

(86) PCT No.: PCT/EP2010/001762

§ 371 (c)(1),
(2), (4) Date: Jul. 25, 2011

(87) PCT Pub. No.: WO2010/124766

PCT Pub. Date: Nov. 4, 2010

(65) Prior Publication Data

US 2011/0303325 A1 Dec. 15, 2011

(30) Foreign Application Priority Data

Apr. 27, 2009 (DE) ..... 10 2009 018 730

(51) Int. Cl.
*B67C 3/02* (2006.01)

(52) U.S. Cl.
USPC ..... 141/104; 141/105; 141/144; 141/145; 141/146

(58) Field of Classification Search
USPC ..... 141/104, 105, 144–146, 237, 392, 89, 141/91
See application file for complete search history.

(56) References Cited

U.S. PATENT DOCUMENTS

| | | | | |
|---|---|---|---|---|
| 2,724,581 | A * | 11/1955 | Pahl et al. | 366/152.1 |
| 4,753,370 | A * | 6/1988 | Rudick | 222/105 |
| 5,000,351 | A * | 3/1991 | Rudick | 222/105 |
| 5,309,820 | A * | 5/1994 | Baxter et al. | 99/280 |
| 6,065,510 | A * | 5/2000 | Andersson et al. | 141/105 |
| 6,810,927 | B2 * | 11/2004 | Ronchi | 141/146 |
| 7,559,346 | B2 * | 7/2009 | Herrick et al. | 141/105 |
| 7,997,448 | B1 * | 8/2011 | Leyva | 222/129.1 |

FOREIGN PATENT DOCUMENTS

| | | |
|---|---|---|
| DE | 202007002055 | 5/2007 |
| EP | 0775668 | 5/1997 |
| EP | 1362825 | 11/2003 |
| WO | 96/09957 | 4/1996 |
| WO | 2009/129937 | 10/2009 |

* cited by examiner

*Primary Examiner* — Timothy L Maust
*Assistant Examiner* — Timothy P Kelly
(74) *Attorney, Agent, or Firm* — Occhiuti & Rohlicek LLP

(57) ABSTRACT

Filling system for filling bottles or similar containers with a liquid consisting of a main component and at least one additional component, said system comprising a plurality of filling elements in which the additional component(s) is/are supplied in controlled quantities via at least one mixing line per filling element in order to be mixed with the main component in the filling element.

18 Claims, 2 Drawing Sheets

FILLING SYSTEM

CROSS-REFERENCE TO RELATED APPLICATIONS

This application is the National Stage of International Application No. PCT/EP2010/001762, filed on Mar. 20, 2010, which claims the benefit of the priority date of German Patent Application No. 10 2009 018 730.8, filed on Apr. 27, 2009. The contents of both applications are hereby incorporated by reference in their entirety.

BACKGROUND

The invention relates to a filling system for filling bottles or other containers with a liquid filling material consisting of a mixture of a main component and at least one additional component, wherein, with a filling material is in the form of a beverage, the main component is, for example, water and the at least one additional component is at least a flavoring.

In production installations of the beverages industry, the main component is usually mixed with one or more additional components in a mixing installation that is separate from the filling machine. The finished filling material or mixed product is then delivered from this mixing installation to the filling machine.

There have been previous proposals for the mixing of at least one main component and at least one additional component to be effected during the filling of the containers, i.e. at the particular filling element and/or in the container itself, with the at least one main component and the at least one additional component being delivered to the particular filling element in the quantity that is necessary for the mixing ratio.

SUMMARY

The object of the invention is to provide a filling system that, with a simplified design, allows a mixing of the main component and at least one additional component at the particular filling element in a precisely proportioned and repeatable manner. This avoids the need for a separate mixing installation.

A first fundamental advantage of the inventive filling system is therefore that, in a production installation in which the inventive filling system or a corresponding filling machine is used, no separate mixing installation is needed to mix the product from the main component and the at least one additional component.

However the invention also has the advantage of a repeatable and precisely proportioned addition of one or more additional components to the main component through the fact that the addition or admixture of the additional component is effected during the actual filling by a proportioning pump that is dedicated to each filling element and preferably by a controllable control valve. In order to simplify the design, at least two proportioning pumps driven by a common motor together form one proportioning unit, for example, with each proportioning unit then being assigned a filling element group in which the number of filling elements equals the number of proportioning pumps in the associated proportioning unit, and each filling element being connected by a mixing line and preferably by a control valve to the outlet of a proportioning pump that is discretely assigned to that filling element.

In one embodiment of the invention, at least two, for example three proportioning pumps driven by a common motor together form a proportioning unit, with each filling element of the filling system being assigned such a proportioning unit that, or whose outlet, is connected by a mixing line to the filling element. Under the control of control valves, the outlet of the proportioning unit can be connected to the outlet of optionally one or more of its proportioning pumps so that, in this embodiment too, the proportioned addition of the at least one additional component to each filling element is effected by a discrete proportioning pump, but it is still possible by appropriate triggering of the control valves to add different additional components or combinations of such additional components to the main component.

To avoid proportioning errors or proportioning inaccuracies in a startup phase of the proportioning pump, the proportioning devices are preferably operated in such a way that, during the filling operation, the proportioning pumps are always driven by the particular motor assigned to multiple proportioning pumps at constant speed and/or delivery rate, and the proportioned delivery of the at least one additional component is effected by opening the normally closed control valve over a time window within which, having regard to the delivery rate of the proportioning pumps, the quantity of the at least one additional component required for admixing is delivered to the related filling element. The proportioning of the additional component can be adjusted by altering the time window and/or by changing the delivery rate of the proportioning pumps or the speed of their drive motors.

Further, embodiments, advantages and possible applications of the invention arise out of the following description of embodiments and out of the figures. All of the described and/or pictorially represented attributes, whether alone or in any desired combination, are fundamentally the subject matter of the invention independently of their synopsis in the claims or a retroactive application thereof. The content of the claims is also made an integral part of the description.

BRIEF DESCRIPTION OF THE DRAWINGS

The invention is explained below in greater detail by reference to

DETAILED DESCRIPTION

Figure 1:
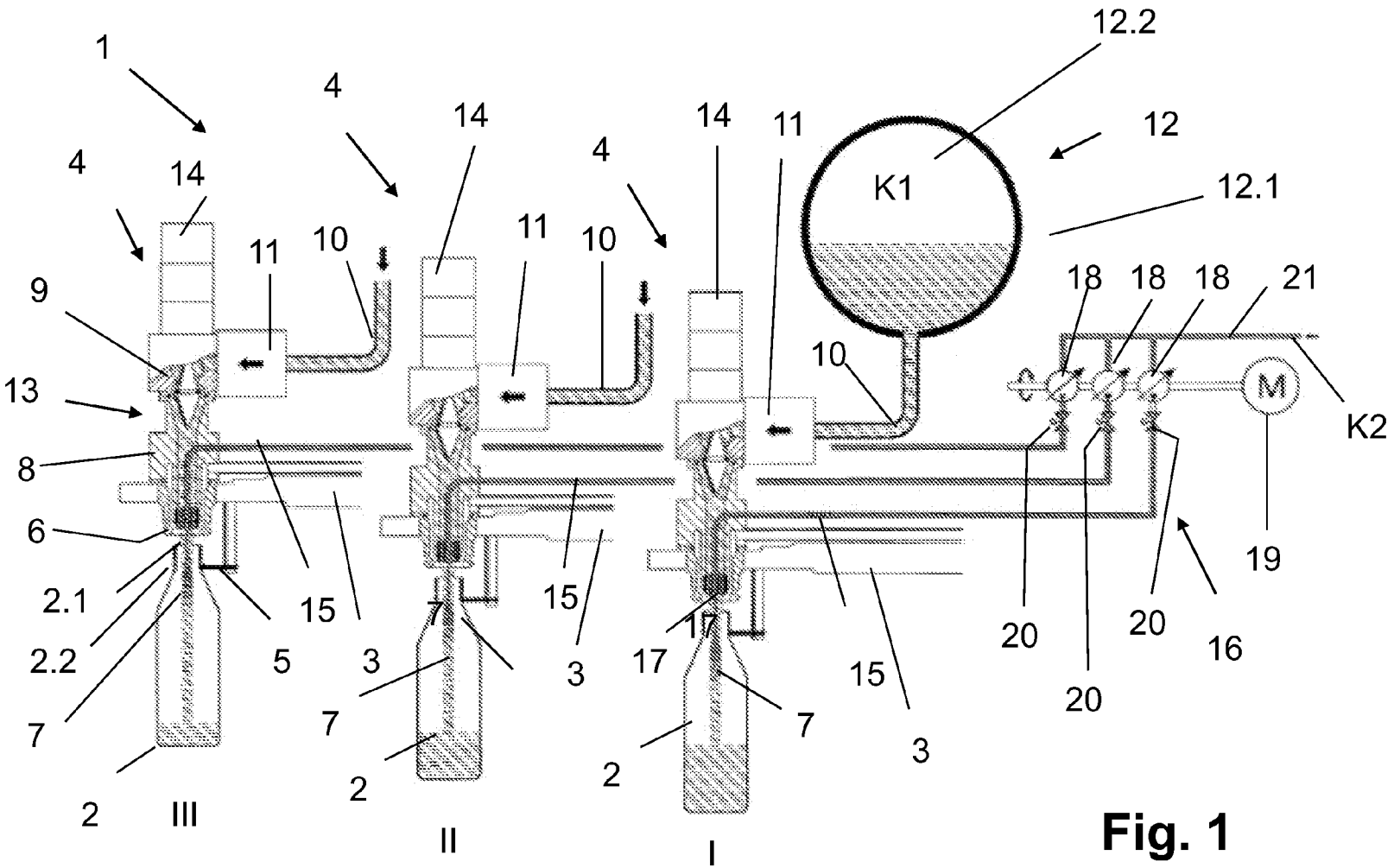
FIGS. 1 and 2 that illustrate three filling elements of a filling system in simplified representation.

The filling system 1, which is shown in FIG. 1, is part of a filling machine, for example of a rotary filling machine for filling bottles 2 with a liquid filling material in the form of a mixture of a main component K1 and a further component or additional component K2. The main component is, for example water, e.g. carbonated water, and the additional component K2 is, for example, a flavoring.

The filling system 1 or the filling machine that exhibits this filling system possesses, on the periphery of a rotor that can be driven to rotate about a vertical machine axis, a plurality of filling elements 4. In FIG. 1, filling elements 4 provided at different angular positions I-III of rotor 3 are shown adjacent to one another for the sake of simplicity. In reality however, like all other filling elements of the filling system 1 or of the filling machine, these filling elements are disposed on the periphery of the common circular or annular rotor 3 in the manner known to the person skilled in the art.

On the rotor 3, each filling element 4 is assigned a container support 5 on which, during filling, a particular bottle is held suspended on a flange 2.2, or a neck ring, that is integrally molded below a bottle mouth 2.1 so as to permit open jet filling. Open jet filling occurs when there is a gap between the bottle mouth 2.1 and the underside of a filling element 4 or a delivery opening 6 formed at that location and when, during filling, an open jet of the liquid filling material 7 crosses this gap and flows into the particular bottle 2.

Inside a filling element housing 8, and in each filling element 4, there is configured a liquid channel 8 that forms the delivery opening 6 on the underside of the filling element 4. A region of the top of the filling element 4 or of the filling element housing 8 is connected to a boiler 12 by a line 10 that incorporates a flow meter 11. The boiler 12 is disposed on rotor 3 and is common to all filling elements 4 of the filling machine.

During filling operations, the boiler 12 is partially filled with the liquid filling material so that a lower liquid space 12.1 is occupied by the filling material and a gas space 12.2 above it is formed inside the boiler 12. In the liquid channel 9, there is provided a liquid valve 13 that, at the start of filling, is opened by an actuating device 14 and that, when the quantity of filling material filled in the particular bottle 2 is reached, is closed again by actuating device 14 in a controlled manner through a measuring signal from the flow meter 11.

A salient feature of the filling system 1 is that the mixing of the main component K1 and the additional component K2 takes place during the filling process, i.e. inside the filling material jet 5 and possibly also inside the particular bottle 2. For this purpose, each filling element 4 is connected, by a proportioning or mixing line 15, to an outlet of a proportioning unit 16, with each proportioning unit 16 being assigned to a group of multiple filling elements 4, in the case of filling system 1 shown in FIG. 1 for example, to three filling elements 4 or to the filling positions of the filling elements 4.

Each mixing line 15 discharges centrally at the delivery opening 6 of its associated filling element 4 and hence centrally at a gas seal 17 that is provided at the particular delivery opening 6 or that forms that delivery opening 6, the gas seal 17 being formed in a manner that is in itself known by way of an insert with a large number of penetrating channels.

Each mixing line 15 has its own separate proportioning pump 18. All proportioning pumps 18 are driven by a common electric motor 19. Proportioning pumps 18 are configured so that, by varying the speed of the motor 19, the delivery rate of the proportioning pump 18, i.e. the quantity of the additional component K2 that is pumped during the filling process and during activation of the proportioning unit 16 through the mixing line 15 to the particular filling element so as to be added to the main component K1 in liquid jet 7 at filling element 4, i.e. when liquid valve 13 is open, can be adjusted in a finely proportioned manner. At the discharge of each proportioning pump 18, there is provided a control valve 20 for effecting the proportioning of the additional component K2 in the manner described below. The proportioning unit 16 is also connected to a line 21 for delivering the additional component K2.

An essential advantage of the filling system 1 is that the mixing of the main component K1 and the additional component K2, i.e. the mixing of the particular product, takes place during the actual filling operation, i.e. with the liquid valve 13 open at the filling element 4, or inside the liquid jet 7, and if necessary, even inside bottle 2. As a result, a production installation that uses a filling machine with the filling system 1 no longer needs to purchase and maintain a separate mixing installation to mix the main and additional components K1 and K2.

Proportioning units 16 and the proportioned delivery of additional component K2 by these units can be controlled in many different ways. One way is to vary the delivery rate of the proportioning pumps 18. This can be carried out by varying the speed of the particular motor 19 and/or by controlling the opening times of the control valves 20 accordingly. Preferentially, the proportioned delivery of the additional component K2 is effected, for example, such that while proportioning pumps 18 are being driven steadily and continuously, the normally closed control valves 20 are opened for the proportioned admixing of the additional component K2 over a time window within which a quantity of the additional component K2 corresponding to the delivery rate of the proportioning pumps 18 is then introduced into the particular mixing line 15 and so added to liquid jet 7 at the associated filling element 4.

To simplify the triggering of individual proportioning units 16, a proportioning unit 16 assigned to each group of filling elements 4 is activated, for example, in common for all filling elements in that group. It goes without saying that the particular proportioning unit 16 is only activated for the proportioned delivery of the additional component K2 during the filling phase. Control valves 20 are preferably not simultaneously activated until the liquid valves 13 of all filling elements 4 assigned to the proportioning unit 16 are open, and with a time delay such that the control valves 20 of each proportioning unit 16 remain closed until a certain quantity of the main component K1 has already been filled in each bottle 2 of the group of filling elements to which this proportioning unit 16 is assigned.

Figure 2:
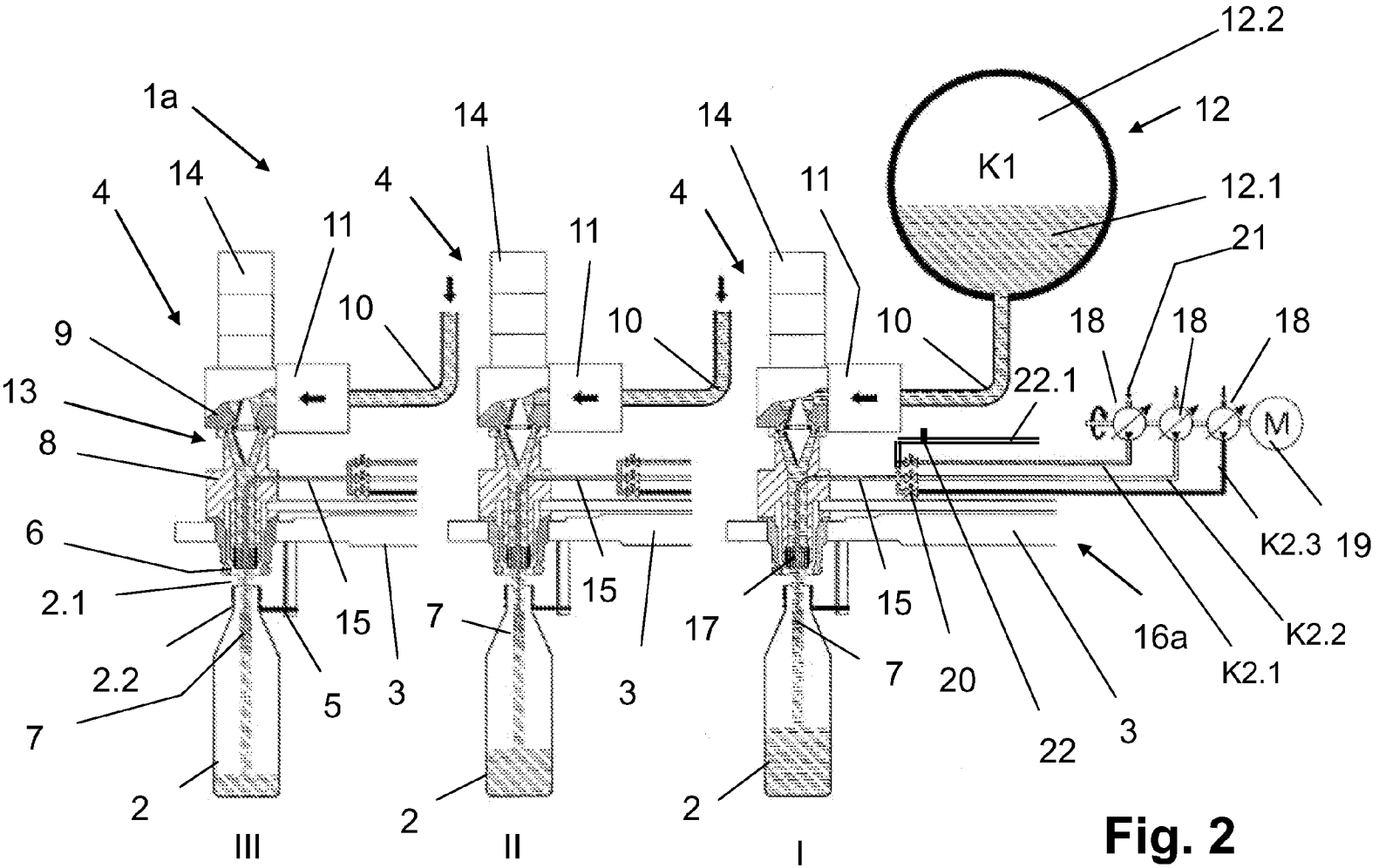

In a representation similar to FIG. 1, FIG. 2 shows, as a further embodiment, three filling elements 4 of a filling system that exhibits a plurality of such filling elements.

Unlike the filling system 1 that is shown in FIG. 1, each filling element 4 in the filling system 1*a* shown in FIG. 2 is assigned to a dedicated set of pumps 18 and lines that lead to that filling element 4, with each line having its own control valve 20. This configuration allows the optional addition of multiple components, i.e. in the embodiment shown, of three additional components K2.1, K2.2 and K2.3, to the main component K1 at the particular filling element 4 or in the liquid jet 7. Otherwise, the filling system 1*a* shown in FIG. 2 is the same as filling system 1, especially as regards the configuration of filling elements 4 and the open jet filling of bottles 2. To assist an understanding of the explanation and graphic representation, the filling elements 4 provided at different angular positions I-III of rotor 3 are again illustrated as being horizontally adjacent to one another. In reality, they would be provided around the periphery of common rotor 3.

A common variable-speed motor 19 is again provided for the proportioning pumps 18. The mixing line 15 for each filling element 4 is connected to three lines for the separate delivery of the additional components K2.1, K2.2 and K2.3. Each of the three lines has its own control valve 20 for that filling element 4. In order to add an additional component K2.1, K2.2 and K2.3 to the main component K1 during filling, the control valve 20 that is assigned respectively to that additional component K2.1, K2.2 and K2.3 is opened. The remaining control valves 20 are closed.

For purging mixing line 15 there is provided, in addition to control valves 20, a control valve 22 by which mixing line 15 can be purged by a purging fluid in order to remove, from mixing line 15, remnants of whatever additional component K2.1.K2.2, K2.3 that was added to the main component K1 before the purging. The purging fluid can be the main component K1, or a beverage-neutral fluid, such as a gaseous or vapor fluid, including, for example, sterile air or an inert gas, such as carbon dioxide gas or nitrogen gas.

The control valve 22, with its associated purging line 22.1 is only shown for one mixing line 15 in FIG. 2 for the sake of greater clarity. In fact, each mixing line 15 actually has its own control valve 22 with its own associated purging line.

The filling system 1*a* makes it possible to add one or more of additional components K2.1-K2.3 during the filling of the main component K1 and to change the filling machine over from one product, which consists of the main component K1 and one or more additional components K2.1-K2.3, to a different product, which consists of the main component and a different additional component. To accomplish this change, the mixing line 15 of each filling element 4 is purged by opening the control valve 22 before the changeover. The mixing lines 15 are purged, for example, at the beginning or each end of each production run, i.e. at the beginning of the filling of a product batch and/or at the end of the filling of a product batch, or for example at the end of each filling phase, i.e. at the end of the filling of a bottle 2. Such purging ensures that repeatable conditions exist at each filling element at the beginning of a new filling phase, i.e. when a further bottle 2 is filled.

The invention has been described hereinbefore by reference to embodiments. It goes without saying that variations as well as modifications are possible without departing from the inventive concept underlying the invention. In particular, the system can also be used analogously for pressurized filling.

LIST OF REFERENCE SIGNS

1, 1*a* Filling System
2 Bottle
2.1 Bottle mouth
2.2 Flange
3 Rotor
4 Filling element
5 Container support
6 Delivery opening
7 Liquid jet
8 Filling element housing
9 Liquid channel
10 Product line
11 Flow meter
12 Boiler for the main component K1
12.1 Liquid space
12.2 Gas space
13 Liquid valve
14 Actuating element
15 Mixing line
16, 16*a* Proportioning unit
17 Gas seal
18 Proportioning pump
19 Pump motor
20 Control valve
21 Line for the additional component
22 Control valve
22.1 Purging line
K1 Main component
K2, K2.1-K2.3 Additional or flavoring component
I, II, II Angular position of filling elements 4 at rotor 3

The invention claimed is:

1. An apparatus for filling containers with a liquid filling material that includes a main component and at least one additional component, said apparatus comprising a filling system, said filling system including a plurality of filling elements, and a plurality of mixing lines for delivering the at least one additional component to the filling elements in correct proportion, each mixing line being connected to an outlet of one of a plurality of proportioning units that includes at least two proportioning pumps driven by a common motor, said common motor having a variable speed, wherein each filling element is assigned to one of said proportioning units, and a first control valve for connecting at least one of the plurality of proportioning pumps to the outlet of the proportioning unit having a plurality of proportioning pumps.

2. The apparatus of claim 1, wherein the filling elements are configured for admixing the additional component of the liquid filling material to the main component of the liquid filling material, and wherein said filling elements are configured in a region of a delivery opening through which the liquid filling material flows into a container.

3. The apparatus of claim 1, wherein the filling elements are configured for admixing the additional component of the liquid filling material to the main component of the liquid filling material in a liquid jet that flows into a container during filling of the container.

4. The apparatus of claim 1, further comprising a control valve disposed to control flow from one of the at least two proportioning pumps to one of the plurality of mixing lines.

5. An apparatus for filling containers with a liquid filling material that includes a main component and at least one additional component, said apparatus comprising a filling system, said filling system including a plurality of filling elements, and a plurality of mixing lines for delivering the at least one additional component to the filling elements in correct proportion, each mixing line being connected to an outlet of a proportioning unit that includes at least two proportioning pumps driven by a common motor, said common motor having a variable speed, and a rotor that can be driven to rotate about a vertical machine axis, wherein filling elements from said plurality of filling elements are disposed on said rotor.

6. The apparatus of claim 5, further comprising a plurality of proportioning units, each of said proportioning units being assigned to a group of filling elements, wherein the number of filling elements in each group of filling elements assigned to a particular proportioning unit is equal to the number of proportioning pumps in the particular proportioning unit.

7. The apparatus of claim 1, wherein the proportional pumps are connected to a common line for delivery of the at least one additional component of the liquid filling material to a container.

8. The apparatus of claim 1, wherein each proportioning pump is connected to a corresponding one of the plurality of mixing lines, each mixing line being for the delivery of a different additional component.

9. The apparatus of claim 1, further comprising at least one second control valve for controlled purging of at least one of the plurality of mixing lines with a fluid.

10. The apparatus of claim 9, wherein the at least one second control valve is disposed on the outlet of the proportioning unit.

11. The apparatus of claim 9, wherein the at least one second control valve is disposed on the at least one of the plurality of mixing lines.

12. The apparatus of claim 1, wherein the proportioning unit is configured for proportional delivery of the at least one additional component by varying a delivery rate of the proportioning pumps.

13. The apparatus of claim 1, wherein the proportioning unit is configured for proportional delivery of the at least one additional component by varying the speed of the common motor.

14. The apparatus of claim 1, wherein the proportioning unit is configured for proportional delivery of the component by controlling an opening time of a control valve between a mixing line and a corresponding proportioning pump.

15. The apparatus of claim 1, further comprising a rotor that can be driven to rotate about a vertical machine axis, wherein filling elements from said plurality of filling elements are disposed on said rotor.

16. The apparatus of claim 1, further comprising a rotor configured to rotate about a machine axis, wherein said plurality of filling elements is disposed around said rotor.

17. The apparatus of claim 5, wherein the proportioning unit comprises at least three proportioning pumps, the three pumps being driven by the common motor.

18. An apparatus for filling containers with a liquid filling material that includes a main component and at least one additional component, said apparatus comprising a filling system, said filling system including a plurality of filling elements, and a plurality of mixing lines for delivering the at least one additional component to the filling elements in correct proportion, each mixing line being connected to an outlet of a proportioning unit that includes at least two proportioning pumps driven by a common motor, said common motor having a variable speed, and a rotor configured to rotate about a machine axis, wherein said plurality of filling elements is disposed around said rotor.

* * * * *